US009745988B2

(12) United States Patent
Hodgson et al.

(10) Patent No.: US 9,745,988 B2
(45) Date of Patent: Aug. 29, 2017

(54) FAN

(71) Applicant: Dyson Technology Limited, Wiltshire (GB)

(72) Inventors: Christopher Steven Hodgson, Bristol (GB); Michael Sean Joynt, Auckland (NZ)

(73) Assignee: Dyson Technology Limited, Malmesbury, Wiltshire (GB)

( * ) Notice: Subject to any disclaimer, the term of this patent is extended or adjusted under 35 U.S.C. 154(b) by 337 days.

(21) Appl. No.: 14/550,572

(22) Filed: Nov. 21, 2014

(65) Prior Publication Data

US 2015/0078885 A1 Mar. 19, 2015

Related U.S. Application Data

(63) Continuation of application No. 13/207,212, filed on Aug. 10, 2011, now Pat. No. 8,894,354.

(30) Foreign Application Priority Data

Sep. 7, 2010 (GB) ..... 1014831.0

(51) Int. Cl.
*F04D 25/08* (2006.01)
*F04D 29/08* (2006.01)
(Continued)

(52) U.S. Cl.
CPC ..... *F04D 25/08* (2013.01); *F04D 29/083* (2013.01); *F04D 29/668* (2013.01); *F04D 29/681* (2013.01)

(58) Field of Classification Search
CPC ..... F04D 25/08; F04D 29/083; F04D 29/681; F04D 29/668
See application file for complete search history.

(56) References Cited

U.S. PATENT DOCUMENTS 1,357,261 A 11/1920 Svoboda
1,767,060 A 6/1930 Ferguson
(Continued)

FOREIGN PATENT DOCUMENTS

AU 2011100923 9/2011
BE 560119 8/1957
(Continued)

OTHER PUBLICATIONS

Search Report dated Dec. 8, 2010 directed GB Application No. 1014831.0; 2 pages.
(Continued)

*Primary Examiner* — Igor Kershteyn
(74) *Attorney, Agent, or Firm* — Morrison & Foerster LLP

(57) ABSTRACT

A fan includes a casing having an air inlet and an air outlet, an impeller housing located within the casing, an impeller located within the impeller housing for generating an air flow along a path extending from the air inlet to the air outlet through the impeller housing, a motor housing connected to the impeller housing, and a motor located within the motor housing for driving the impeller. A bellows support is provided for mounting the impeller housing within the casing. The bellows support is disposed on a seat connected to the casing. The bellows support extends about the impeller housing and forms a seal between the impeller housing and the casing.

13 Claims, 8 Drawing Sheets

(51) Int. Cl.
*F04D 29/68* (2006.01)
*F04D 29/66* (2006.01)

(56) References Cited

U.S. PATENT DOCUMENTS 1,896,869 A 2/1933 Larsh
2,014,185 A 9/1935 Martin
2,035,733 A 3/1936 Wall
D103,476 S 3/1937 Weber
2,115,883 A 5/1938 Sher
D115,344 S 6/1939 Chapman
2,210,458 A 8/1940 Keilholtz
2,258,961 A 10/1941 Saathoff
2,336,295 A 12/1943 Reimuller
2,433,795 A 12/1947 Stokes
2,473,325 A 6/1949 Aufiero
2,476,002 A 7/1949 Stalker
2,488,467 A 11/1949 De Lisio
2,510,132 A 6/1950 Morrison
2,544,379 A 3/1951 Davenport
2,547,448 A 4/1951 Demuth
2,583,374 A 1/1952 Hoffman
2,620,127 A 12/1952 Radcliffe
2,765,977 A 10/1956 Morrison
2,808,198 A 10/1957 Morrison
2,813,673 A 11/1957 Smith
2,830,779 A 4/1958 Wentling
2,838,229 A 6/1958 Belanger
2,922,277 A 1/1960 Bertin
2,922,570 A 1/1960 Allen
3,004,403 A 10/1961 Laporte
3,047,208 A 7/1962 Coanda
3,270,655 A 9/1966 Guirl et al.
D206,973 S 2/1967 De Lisio
3,444,817 A 5/1969 Caldwell
3,503,138 A 3/1970 Fuchs et al.
3,518,776 A 7/1970 Wolff et al.
3,724,092 A 4/1973 McCleerey
3,743,186 A 7/1973 Mocarski
3,795,367 A 3/1974 Mocarski
3,872,916 A 3/1975 Beck
3,875,745 A 4/1975 Franklin
3,885,891 A 5/1975 Throndson
3,943,329 A 3/1976 Hlavac
4,037,991 A 7/1977 Taylor
4,046,492 A 9/1977 Inglis
4,061,188 A 12/1977 Beck
4,073,613 A 2/1978 Desty
4,113,416 A 9/1978 Kataoka et al.
4,136,735 A 1/1979 Beck et al.
4,173,995 A 11/1979 Beck
4,180,130 A 12/1979 Beck et al.
4,184,541 A 1/1980 Beck et al.
4,192,461 A 3/1980 Arborg
4,332,529 A 6/1982 Alperin
4,336,017 A 6/1982 Desty
4,342,204 A 8/1982 Melikian et al.
4,448,354 A 5/1984 Reznick et al.
4,502,837 A 3/1985 Blair et al.
4,568,243 A 2/1986 Schubert et al.
4,630,475 A 12/1986 Mizoguchi
4,643,351 A 2/1987 Fukamachi et al.
4,703,152 A 10/1987 Shih-Chin
4,718,870 A 1/1988 Watts
4,732,539 A 3/1988 Shin-Chin
4,790,133 A 12/1988 Stuart
4,850,804 A 7/1989 Huang
4,878,620 A 11/1989 Tarleton
4,893,990 A 1/1990 Tomohiro et al.
4,978,281 A 12/1990 Conger
5,061,405 A 10/1991 Stanek et al.
D325,435 S 4/1992 Coup et al.
5,168,722 A 12/1992 Brock
5,176,856 A 1/1993 Takahashi et al.
5,188,508 A 2/1993 Scott et al.
5,296,769 A 3/1994 Havens et al.
5,310,313 A 5/1994 Chen
5,317,815 A 6/1994 Hwang
5,402,938 A 4/1995 Sweeney
5,407,324 A 4/1995 Starnes, Jr. et al.
5,425,902 A 6/1995 Miller et al.
5,518,370 A 5/1996 Wang et al.
5,609,473 A 3/1997 Litvin
5,645,769 A 7/1997 Tamaru et al.
5,649,370 A 7/1997 Russo
5,730,582 A 3/1998 Heitmann
5,735,683 A 4/1998 Muschelknautz
5,762,034 A 6/1998 Foss
5,762,661 A 6/1998 Kleinberger et al.
5,783,117 A 7/1998 Byassee et al.
D398,983 S 9/1998 Keller et al.
5,841,080 A 11/1998 Iida et al.
5,843,344 A 12/1998 Junkel et al.
5,862,037 A 1/1999 Behl
5,868,197 A 2/1999 Potier
5,881,685 A 3/1999 Foss et al.
D415,271 S 10/1999 Feer
6,015,274 A 1/2000 Bias et al.
6,065,936 A 5/2000 Shingai et al.
6,073,881 A 6/2000 Chen
6,082,969 A 7/2000 Carroll et al.
D429,808 S 8/2000 Krauss et al.
6,123,618 A 9/2000 Day
6,155,782 A 12/2000 Hsu
D435,899 S 1/2001 Melwani
6,254,337 B1 7/2001 Arnold
6,269,549 B1 8/2001 Carlucci et al.
6,278,248 B1 8/2001 Hong et al.
6,282,746 B1 9/2001 Schleeter
6,293,121 B1 9/2001 Labrador
6,321,034 B2 11/2001 Jones-Lawlor et al.
6,338,610 B1 1/2002 Harada et al.
6,348,106 B1 2/2002 Embree et al.
6,386,845 B1 5/2002 Bedard
6,454,527 B2 9/2002 Nishiyama et al.
6,480,672 B1 11/2002 Rosenzweig et al.
6,511,288 B1 1/2003 Gatley, Jr.
6,599,088 B2 7/2003 Stagg
D485,895 S 1/2004 Melwani
6,709,236 B1 3/2004 Holzer
6,789,787 B2 9/2004 Stutts
6,830,433 B2 12/2004 Birdsell et al.
7,059,826 B2 6/2006 Lasko
7,088,913 B1 8/2006 Verhoorn et al.
7,147,336 B1 12/2006 Chou
D539,414 S 3/2007 Russak et al.
7,186,075 B2 3/2007 Winkler et al.
7,189,053 B2 3/2007 Winkler et al.
7,317,267 B2 1/2008 Schmid et al.
7,455,504 B2 11/2008 Hill et al.
7,478,993 B2 1/2009 Hong et al.
7,540,474 B1 6/2009 Huang et al.
D598,532 S 8/2009 Dyson et al.
D602,143 S 10/2009 Gammack et al.
D602,144 S 10/2009 Dyson et al.
D605,748 S 12/2009 Gammack et al.
7,664,377 B2 2/2010 Liao
D614,280 S 4/2010 Dyson et al.
7,775,848 B1 8/2010 Auerbach
7,806,388 B2 10/2010 Junkel et al.
7,885,065 B2 * 2/2011 Kaneko ..... F04D 25/0613 361/679.48
7,921,962 B2 4/2011 Liddell
8,092,166 B2 1/2012 Nicolas et al.
8,430,624 B2 4/2013 Cookson et al.
8,469,658 B2 6/2013 Gammack et al.
2002/0106547 A1 8/2002 Sugawara et al.
2003/0059307 A1 3/2003 Moreno et al.
2003/0171093 A1 9/2003 Gumucio Del Pozo
2004/0022631 A1 2/2004 Birdsell et al.
2004/0049842 A1 3/2004 Prehodka
2004/0149881 A1 8/2004 Allen
2005/0031448 A1 2/2005 Lasko et al.
2005/0053465 A1 3/2005 Roach et al.

(56) References Cited

U.S. PATENT DOCUMENTS

| | | | |
|---|---|---|---|
| 2005/0069407 | A1 | 3/2005 | Winkler et al. |
| 2005/0128698 | A1 | 6/2005 | Huang |
| 2005/0163670 | A1 | 7/2005 | Alleyne et al. |
| 2005/0173997 | A1 | 8/2005 | Schmid et al. |
| 2005/0276684 | A1 | 12/2005 | Huang et al. |
| 2005/0281672 | A1 | 12/2005 | Parker et al. |
| 2006/0172682 | A1 | 8/2006 | Orr et al. |
| 2006/0199515 | A1 | 9/2006 | Lasko et al. |
| 2007/0035189 | A1 | 2/2007 | Matsumoto |
| 2007/0041857 | A1 | 2/2007 | Fleig |
| 2007/0048159 | A1 | 3/2007 | DiMatteo et al. |
| 2007/0065280 | A1 | 3/2007 | Fok |
| 2007/0166160 | A1 | 7/2007 | Russak et al. |
| 2007/0176502 | A1 | 8/2007 | Kasai et al. |
| 2007/0224044 | A1 | 9/2007 | Hong et al. |
| 2007/0269323 | A1 | 11/2007 | Zhou et al. |
| 2008/0020698 | A1 | 1/2008 | Spaggiari |
| 2008/0152482 | A1 | 6/2008 | Patel |
| 2008/0166224 | A1 | 7/2008 | Giffin |
| 2008/0286130 | A1 | 11/2008 | Purvines |
| 2008/0304986 | A1 | 12/2008 | Kenyon et al. |
| 2008/0314250 | A1 | 12/2008 | Cowie et al. |
| 2009/0026850 | A1 | 1/2009 | Fu |
| 2009/0039805 | A1 | 2/2009 | Tang |
| 2009/0060710 | A1 | 3/2009 | Gammack et al. |
| 2009/0060711 | A1 | 3/2009 | Gammack et al. |
| 2009/0191054 | A1 | 7/2009 | Winkler |
| 2009/0214341 | A1 | 8/2009 | Craig |
| 2010/0150699 | A1 | 6/2010 | Nicolas et al. |
| 2010/0162011 | A1 | 6/2010 | Min |
| 2010/0171465 | A1 | 7/2010 | Seal et al. |
| 2010/0225012 | A1 | 9/2010 | Fitton et al. |
| 2010/0226749 | A1 | 9/2010 | Gammack et al. |
| 2010/0226750 | A1 | 9/2010 | Gammack |
| 2010/0226751 | A1 | 9/2010 | Gammack et al. |
| 2010/0226752 | A1 | 9/2010 | Gammack et al. |
| 2010/0226753 | A1 | 9/2010 | Dyson et al. |
| 2010/0226754 | A1 | 9/2010 | Hutton et al. |
| 2010/0226758 | A1 | 9/2010 | Cookson et al. |
| 2010/0226763 | A1 | 9/2010 | Gammack et al. |
| 2010/0226764 | A1 | 9/2010 | Gammack et al. |
| 2010/0226769 | A1 | 9/2010 | Helps |
| 2010/0226771 | A1 | 9/2010 | Crawford et al. |
| 2010/0226787 | A1 | 9/2010 | Gammack et al. |
| 2010/0226797 | A1 | 9/2010 | Fitton et al. |
| 2010/0226801 | A1 | 9/2010 | Gammack |
| 2010/0254800 | A1 | 10/2010 | Fitton et al. |
| 2011/0002775 | A1 | 1/2011 | Ma et al. |
| 2011/0058935 | A1 | 3/2011 | Gammack et al. |
| 2011/0110805 | A1 | 5/2011 | Gammack et al. |
| 2011/0164959 | A1 | 7/2011 | Fitton et al. |
| 2011/0223014 | A1 | 9/2011 | Crawford et al. |
| 2011/0223015 | A1 | 9/2011 | Gammack et al. |
| 2012/0031509 | A1 | 2/2012 | Wallace et al. |
| 2012/0033952 | A1 | 2/2012 | Wallace et al. |
| 2012/0034108 | A1 | 2/2012 | Wallace et al. |
| 2012/0039705 | A1 | 2/2012 | Gammack |
| 2012/0045315 | A1 | 2/2012 | Gammack |
| 2012/0045316 | A1 | 2/2012 | Gammack |
| 2012/0082561 | A1 | 4/2012 | Gammack et al. |
| 2012/0093629 | A1 | 4/2012 | Fitton et al. |
| 2012/0093630 | A1 | 4/2012 | Fitton et al. |
| 2012/0114513 | A1 | 5/2012 | Simmonds et al. |
| 2012/0230658 | A1 | 9/2012 | Fitton et al. |
| 2013/0011252 | A1 | 1/2013 | Crawford et al. |
| 2013/0045084 | A1 | 2/2013 | Tu et al. |
| 2013/0189083 | A1 | 7/2013 | Atkinson |
| 2013/0302156 | A1 | 11/2013 | Nurzynski |
| 2013/0309065 | A1 | 11/2013 | Johnson et al. |
| 2013/0309066 | A1 | 11/2013 | Atkinson et al. |
| 2013/0309080 | A1 | 11/2013 | Johnson et al. |
| 2013/0323025 | A1 | 12/2013 | Crawford et al. |
| 2014/0017069 | A1 | 1/2014 | Peters |

FOREIGN PATENT DOCUMENTS

| | | |
|---|---|---|
| CA | 1055344 | 5/1979 |
| CA | 2155482 | 9/1996 |
| CH | 346643 | 5/1960 |
| CN | 2085866 | 10/1991 |
| CN | 2111392 | 7/1992 |
| CN | 2228996 | 6/1996 |
| CN | 1232143 | 10/1999 |
| CN | 1288506 | 3/2001 |
| CN | 1336482 | 2/2002 |
| CN | 1437300 | 8/2003 |
| CN | 2650005 | 10/2004 |
| CN | 2713643 | 7/2005 |
| CN | 1680727 | 10/2005 |
| CN | 2833197 | 11/2006 |
| CN | 101046318 | 10/2007 |
| CN | 201180678 | 1/2009 |
| CN | 201221477 | 4/2009 |
| CN | 201281416 | 7/2009 |
| CN | 201349269 | 11/2009 |
| CN | 101749288 | 6/2010 |
| CN | 201502549 | 6/2010 |
| CN | 101816534 | 9/2010 |
| CN | 101825095 | 9/2010 |
| CN | 101825102 | 9/2010 |
| CN | 201568337 | 9/2010 |
| CN | 101936310 | 1/2011 |
| CN | 101984299 | 3/2011 |
| CN | 101985948 | 3/2011 |
| CN | 201763705 | 3/2011 |
| CN | 201763706 | 3/2011 |
| CN | 201770513 | 3/2011 |
| CN | 201779080 | 3/2011 |
| CN | 201802648 | 4/2011 |
| CN | 102095236 | 6/2011 |
| CN | 102305220 | 1/2012 |
| CN | 102367813 | 3/2012 |
| CN | 202165330 | 3/2012 |
| DE | 1 291 090 | 3/1969 |
| DE | 24 51 557 | 5/1976 |
| DE | 27 48 724 | 5/1978 |
| DE | 3644567 | 7/1988 |
| DE | 41 27 134 | 2/1993 |
| DE | 195 10 397 | 9/1996 |
| DE | 197 12 228 | 10/1998 |
| DE | 100 00 400 | 3/2001 |
| DE | 10041805 | 6/2002 |
| DE | 10 2009 007 | 8/2010 |
| DE | 10 2009 044 | 5/2011 |
| EP | 0 044 494 | 1/1982 |
| EP | 0 186 581 | 7/1986 |
| EP | 0 837 245 | 4/1998 |
| EP | 0 955 469 | 11/1999 |
| EP | 1 094 224 | 4/2001 |
| EP | 1 138 954 | 10/2001 |
| EP | 1 566 548 | 8/2005 |
| EP | 1 779 745 | 5/2007 |
| EP | 1 939 456 | 7/2008 |
| EP | 1 980 432 | 10/2008 |
| EP | 2 000 675 | 12/2008 |
| EP | 2191142 | 6/2010 |
| FR | 1033034 | 7/1953 |
| FR | 1119439 | 6/1956 |
| FR | 1.387.334 | 1/1965 |
| FR | 2 534 983 | 4/1984 |
| FR | 2 640 857 | 6/1990 |
| FR | 2 658 593 | 8/1991 |
| FR | 2794195 | 12/2000 |
| FR | 2 874 409 | 2/2006 |
| FR | 2 906 980 | 4/2008 |
| GB | 22235 | 6/1914 |
| GB | 383498 | 11/1932 |
| GB | 593828 | 10/1947 |
| GB | 601222 | 4/1948 |
| GB | 633273 | 12/1949 |
| GB | 641622 | 8/1950 |
| GB | 661747 | 11/1951 |
| GB | 863 124 | 3/1961 |

(56) References Cited

FOREIGN PATENT DOCUMENTS

| | | |
|---|---|---|
| GB | 1067956 | 5/1967 |
| GB | 1 262 131 | 2/1972 |
| GB | 1 265 341 | 3/1972 |
| GB | 1 278 606 | 6/1972 |
| GB | 1 304 560 | 1/1973 |
| GB | 1 403 188 | 8/1975 |
| GB | 1 434 226 | 5/1976 |
| GB | 1 501 473 | 2/1978 |
| GB | 2 094 400 | 9/1982 |
| GB | 2 107 787 | 5/1983 |
| GB | 2 111 125 | 6/1983 |
| GB | 2 178 256 | 2/1987 |
| GB | 2 185 531 | 7/1987 |
| GB | 2 185 533 | 7/1987 |
| GB | 2 218 196 | 11/1989 |
| GB | 2 236 804 | 4/1991 |
| GB | 2 237 323 | 5/1991 |
| GB | 2 240 268 | 7/1991 |
| GB | 2 242 935 | 10/1991 |
| GB | 2 285 504 | 7/1995 |
| GB | 2 289 087 | 11/1995 |
| GB | 2383277 | 6/2003 |
| GB | 2 428 569 | 2/2007 |
| GB | 2 452 593 | 3/2009 |
| GB | 2452490 | 3/2009 |
| GB | 2463698 | 3/2010 |
| GB | 2464736 | 4/2010 |
| GB | 2466058 | 6/2010 |
| GB | 2468312 | 9/2010 |
| GB | 2468313 | 9/2010 |
| GB | 2468315 | 9/2010 |
| GB | 2468319 | 9/2010 |
| GB | 2468320 | 9/2010 |
| GB | 2468323 | 9/2010 |
| GB | 2468328 | 9/2010 |
| GB | 2468331 | 9/2010 |
| GB | 2468369 | 9/2010 |
| GB | 2473037 | 3/2011 |
| GB | 2479760 | 10/2011 |
| GB | 2482547 | 2/2012 |
| JP | 31-13055 | 8/1956 |
| JP | 35-4369 | 3/1960 |
| JP | 39-7297 | 3/1964 |
| JP | 49-150403 | 12/1974 |
| JP | 51-7258 | 1/1976 |
| JP | 53-51608 | 5/1978 |
| JP | 53-60100 | 5/1978 |
| JP | 56-167897 | 12/1981 |
| JP | 57-71000 | 5/1982 |
| JP | 57-157097 | 9/1982 |
| JP | 59-90797 | 5/1984 |
| JP | 59-167984 | 11/1984 |
| JP | 60-105896 | 7/1985 |
| JP | 61-31830 | 2/1986 |
| JP | 61-116093 | 6/1986 |
| JP | 61-280787 | 12/1986 |
| JP | 62-223494 | 10/1987 |
| JP | 63-179198 | 7/1988 |
| JP | 63-306340 | 12/1988 |
| JP | 64-21300 | 2/1989 |
| JP | 64-83884 | 3/1989 |
| JP | 1-138399 | 5/1989 |
| JP | 1-224598 | 9/1989 |
| JP | 2-146294 | 6/1990 |
| JP | 2-218890 | 8/1990 |
| JP | 2-248690 | 10/1990 |
| JP | 3-3419 | 1/1991 |
| JP | 3-52515 | 5/1991 |
| JP | 3-267598 | 11/1991 |
| JP | 4-43895 | 2/1992 |
| JP | 4-366330 | 12/1992 |
| JP | 5-157093 | 6/1993 |
| JP | 5-164089 | 6/1993 |
| JP | 5-263786 | 10/1993 |
| JP | 6-74190 | 3/1994 |
| JP | 6-86898 | 3/1994 |
| JP | 6-147188 | 5/1994 |
| JP | 6-257591 | 9/1994 |
| JP | 6-280800 | 10/1994 |
| JP | 6-336113 | 12/1994 |
| JP | 7-190443 | 7/1995 |
| JP | 7-247991 | 9/1995 |
| JP | 8-21400 | 1/1996 |
| JP | 9-100800 | 4/1997 |
| JP | 9-287600 | 11/1997 |
| JP | 10-122188 | 5/1998 |
| JP | 11-227866 | 8/1999 |
| JP | 2000-116179 | 4/2000 |
| JP | 2000-201723 | 7/2000 |
| JP | 2001-17358 | 1/2001 |
| JP | 2001-295785 | 10/2001 |
| JP | 2002-21797 | 1/2002 |
| JP | 2002-138829 | 5/2002 |
| JP | 2002-213388 | 7/2002 |
| JP | 2003-329273 | 11/2003 |
| JP | 2004-8275 | 1/2004 |
| JP | 2004-208935 | 7/2004 |
| JP | 2004-216221 | 8/2004 |
| JP | 2005-201507 | 7/2005 |
| JP | 2005-307985 | 11/2005 |
| JP | 2006-89096 | 4/2006 |
| JP | 3127331 | 11/2006 |
| JP | 2007-138763 | 6/2007 |
| JP | 2007-138789 | 6/2007 |
| JP | 2008-39316 | 2/2008 |
| JP | 2008-100204 | 5/2008 |
| JP | 3146538 | 10/2008 |
| JP | 2008-294243 | 12/2008 |
| JP | 2009-44568 | 2/2009 |
| JP | 2009-264121 | 11/2009 |
| JP | 2010-131259 | 6/2010 |
| JP | 2012-36897 | 2/2012 |
| JP | 2012-57619 | 3/2012 |
| KR | 2002-0061691 | 7/2002 |
| KR | 2002-0067468 | 8/2002 |
| KR | 10-2005-0102317 | 10/2005 |
| KR | 10-2007-0007997 | 1/2007 |
| KR | 10-2010-0055611 | 5/2010 |
| KR | 2000-0032363 | 6/2010 |
| KR | 10-0985378 | 9/2010 |
| TW | M394383 | 12/2010 |
| TW | M407299 | 7/2011 |
| WO | WO-90/13478 | 11/1990 |
| WO | WO-02/073096 | 9/2002 |
| WO | WO-03/058795 | 7/2003 |
| WO | WO-03/069931 | 8/2003 |
| WO | WO-2005/050026 | 6/2005 |
| WO | WO-2005/057091 | 6/2005 |
| WO | WO-2006/008021 | 1/2006 |
| WO | WO-2006/012526 | 2/2006 |
| WO | WO-2007/024955 | 3/2007 |
| WO | WO-2007/048205 | 5/2007 |
| WO | WO-2008/014641 | 2/2008 |
| WO | WO-2008/024569 | 2/2008 |
| WO | WO-2009/030879 | 3/2009 |
| WO | WO-2009/030881 | 3/2009 |
| WO | WO-2010/100448 | 9/2010 |
| WO | WO-2010/100451 | 9/2010 |
| WO | WO-2010/100452 | 9/2010 |
| WO | WO-2010/100453 | 9/2010 |
| WO | WO-2010/100462 | 9/2010 |
| WO | WO-2011/055134 | 5/2011 |

OTHER PUBLICATIONS

International Search Report and Written Opinion mailed Nov. 18, 2011, directed to International Patent Application No. PCT/GB2011/051566; 11 pages.

Reba, I. (1966). "Applications of the Coanda Effect," *Scientific American* 214:84-92.

Third Party Submission Under 37 CFR 1.99 filed Jun. 2, 2011, directed to U.S. Appl. No. 12/203,698; 3 pages.

(56) References Cited

OTHER PUBLICATIONS

Gammack et al., U.S. Office Action mailed Dec. 9, 2010, directed to U.S. Appl. No. 12/203,698; 10 pages.
Gammack et al., U.S. Office Action mailed Jun. 21, 2011, directed to U.S. Appl. No. 12/203,698; 11 pages.
Gammack et al., U.S. Office Action mailed Sep. 17, 2012, directed to U.S. Appl. No. 13/114,707; 12 pages.
Gammack et al., U.S. Office Action mailed Dec. 10, 2010, directed to U.S. Appl. No. 12/230,613; 12 pages.
Gammack et al., U.S. Office Action mailed May 13, 2011, directed to U.S. Appl. No. 12/230,613; 13 pages.
Gammack et al., U.S. Office Action mailed Sep. 7, 2011, directed to U.S. Appl. No. 12/230,613; 15 pages.
Gammack et al., U.S. Office Action mailed Jun. 8, 2012, directed to U.S. Appl. No. 12/230,613; 15 pages.
Gammack et al., U.S. Office Action mailed Aug. 20, 2012, directed to U.S. Appl. No. 12/945,558; 15 pages.
Fitton et al., U.S. Office Action mailed Nov. 30, 2010 directed to U.S. Appl. No. 12/560,232; 9 pages.
Nicolas et al., U.S. Office Action mailed Mar. 7, 2011, directed to U.S. Appl. No. 12/622,844; 10 pages.
Nicolas et al., U.S. Office Action mailed Sep. 8, 2011, directed to U.S. Appl. No. 12/622,844; 11 pages.
Gammack et al., U.S. Office Action mailed Dec. 9, 2010, directed to U.S. Appl. No. 12/716,781; 17 pages.
Gammack et al., U.S. Office Action mailed Jun. 24, 2011, directed to U.S. Appl. No. 12/716,781; 19 pages.
Fitton et al., U.S. Office Action mailed Mar. 30, 2012, directed to U.S. Appl. No. 12/716,707; 7 pages.
Gammack et al., U.S. Office Action mailed Nov. 29, 2012, directed to U.S. Appl. No. 12/716,742; 9 pages.
Cookson et al., U.S. Office Action mailed Dec. 19, 2012, directed to U.S. Appl. No. 12/716,778; 8 pages.
Hodgson et al., U.S. Office Action mailed Mar. 24, 2014, directed to U.S. Appl. No. 13/207,212; 10 pages.
Gammack et al., U.S. Office Action mailed Apr. 12, 2011, directed to U.S. Appl. No. 12/716,749; 8 pages.
Gammack et al., U.S. Office Action mailed Sep. 1, 2011, directed to U.S. Appl. No. 12/716,749; 9 pages.
Gammack et al., U.S. Office Action mailed Jun. 25, 2012, directed to U.S. Appl. No. 12/716,749; 11 pages.
Gammack et al., U.S. Office Action mailed May 24, 2011, directed to U.S. Appl. No. 12/716,613; 9 pages.
Fitton et al., U.S. Office Action mailed Mar. 8, 2011, directed to U.S. Appl. No. 12/716,780; 12 pages.
Fitton et al., U.S. Office Action mailed Sep. 6, 2011, directed to U.S. Appl. No. 12/716,780; 16 pages.

* cited by examiner

FAN

REFERENCE TO RELATED APPLICATIONS

This application is a continuation of U.S. patent application Ser. No. 13/207,212, filed Aug. 10, 2011, which claims the priority of United Kingdom Application No. 1014831.0, filed Sep. 7, 2010, the entire contents of which are incorporated herein by reference.

FIELD OF THE INVENTION

The present invention relates to a portable fan. Particularly, but not exclusively, the present invention relates to a floor or table-top fan, such as a desk, tower or pedestal fan.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation. The blades are generated located within a cage which allows an air flow to pass through the housing while preventing users from coming into contact with the rotating blades during use of the fan.

WO 2009/030879 describes a fan assembly which does not use caged blades to project air from the fan assembly. Instead, the fan assembly comprises a cylindrical base which houses a motor-driven impeller for drawing a primary air flow into the base, and an annular nozzle connected to the base and comprising an annular air outlet through which the primary air flow is emitted from the fan. The nozzle defines a central opening through which air in the local environment of the fan assembly is drawn by the primary air flow emitted from the mouth, amplifying the primary air flow.

Our co-pending patent application PCT/GB2010/050270 also describes such a fan assembly. Within the base, the impeller is located within an impeller housing, and the motor for driving the impeller is located within a motor bucket which is mounted on the impeller housing. The impeller housing is supported within the base by a plurality of angularly spaced supports. Each support is, in turn, mounted on a respective support surface extending radially inwardly from the inner surface of the base. In order to provide an air tight seal between the impeller housing and the base, a lip seal is located on the outer surface of the impeller housing for engaging the inner surface of the base.

SUMMARY OF THE INVENTION

In a first aspect, the present invention provides a fan comprising a casing having an air inlet and an air outlet, an impeller housing located within the casing, an impeller located within the impeller housing for generating an air flow along a path extending from the air inlet to the air outlet through the impeller housing, a motor housing connected to the impeller housing, a motor located within the motor housing for driving the impeller, and a bellows support for supporting the impeller housing within the casing, the bellows support being mounted on a seat connected to the casing, the bellows support extending about the impeller housing and forming a seal between the impeller housing and the casing.

We have found that the use of a bellows support for mounting the impeller housing within the casing can reduce the transmission of vibrations from the motor housing to the casing in comparison to when a plurality of angularly spaced supports are used to mount the impeller housing within the casing. The bellows support can also form a seal between the casing and the impeller housing to prevent air from leaking back towards the air inlet of the casing along a path extending between the casing and the impeller housing, thereby forcing the pressurized air flow generated by the impeller to pass to the air outlet of the casing. As a separate lip seal is not required for sealing between the impeller housing and the casing, the number of components of the fan, and therefore the manufacturing and assembly costs, can be reduced.

The bellows support is preferably arranged within the casing so as to bear evenly thereabout the weight of the impeller, impeller housing, motor and motor housing. The bellows support preferably comprises an upper end connected to the impeller housing, and a lower end disposed on the seat. For example, the upper end of the bellows support may comprise a groove for retaining a generally annular rib located on the outer surface of the impeller housing, thereby forming a seal between the impeller housing and the bellows support. The bellows support preferably comprises a sealing member, preferably in the form of a lip seal, for engaging the inner surface of the casing. The lip seal is preferably integral with the bellows support.

The fan preferably comprises means for inhibiting rotation of the bellows support relative to the casing. For example, the seat may comprise a plurality of angularly spaced support surfaces and the rotation inhibiting means may comprise at least one rotation inhibiting member connected to the bellows support and located between adjacent support surfaces so that any rotational force acting on the bellows support urges the rotation inhibiting member against a side wall of one of these adjacent support surfaces. In a preferred embodiment, the rotation inhibiting means comprises a plurality of such rotation inhibiting members each located adjacent a respective one of the adjacent support surfaces.

The bellows support is preferably substantially co-axial with the impeller. The fan preferably comprises means for inhibiting radial displacement of the bellows support relative to the casing away from its co-axial alignment with the impeller. In a preferred embodiment the radial displacement inhibiting means comprises a collar connected to the bellows. This collar preferably depends downwardly from the lower end of the bellows support. The collar may be surrounded by the seat so that any radial force acting on the bellows support urges the collar against the seat to inhibit radial displacement of the bellows support relative to the seat.

The seat preferably extends radially inwardly from the inner surface of the casing. The seat is preferably integral with the casing.

The impeller housing preferably comprises a shroud extending about and substantially concentric with the impeller.

In a second aspect, the present invention also provides a fan comprising a casing having an air inlet and an air outlet, an impeller housing located within the casing, an impeller located within the impeller housing for generating an air flow along a path extending from the air inlet to the air outlet through the impeller housing, a motor housing connected to the impeller housing, a motor located within the motor housing for driving the impeller, and a bellows extending about the impeller housing and forming a seal between the impeller housing and the casing.

Features described above in connection with the first aspect of the invention are equally applicable to the second aspect of the invention, and vice versa.

BRIEF DESCRIPTION OF THE DRAWINGS

Preferred features of the invention will now be described, by way of example only, with reference to the accompanying drawings, in which.

DETAILED DESCRIPTION OF THE INVENTION

Figure 1:
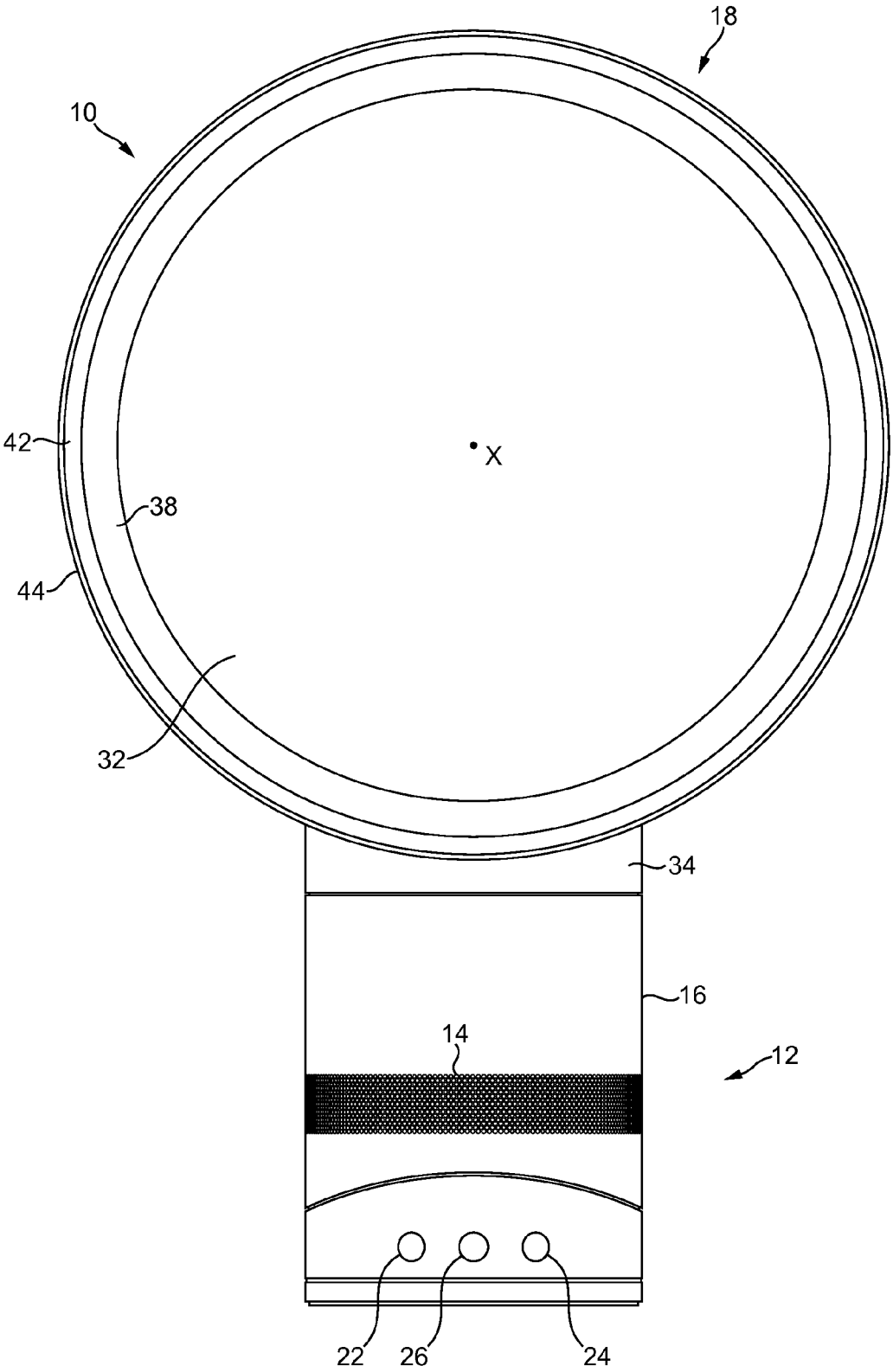
FIG. 1 is a front view of a fan.

FIG. 1 is a front view of a fan 10. The fan comprises a body 12 having an air inlet 14 in the form of a plurality of apertures formed in the outer casing 16 of the body 12, and through which a primary air flow is drawn into the body 12 from the external environment. An annular casing 18 having an air outlet 20 for emitting the primary air flow from the fan 10 is connected to the body 12. The body 12 further comprises a user interface for allowing a user to control the operation of the fan 10. The user interface comprises a plurality of user-operable buttons 22, 24 and a user-operable dial 26.

Figure 2:
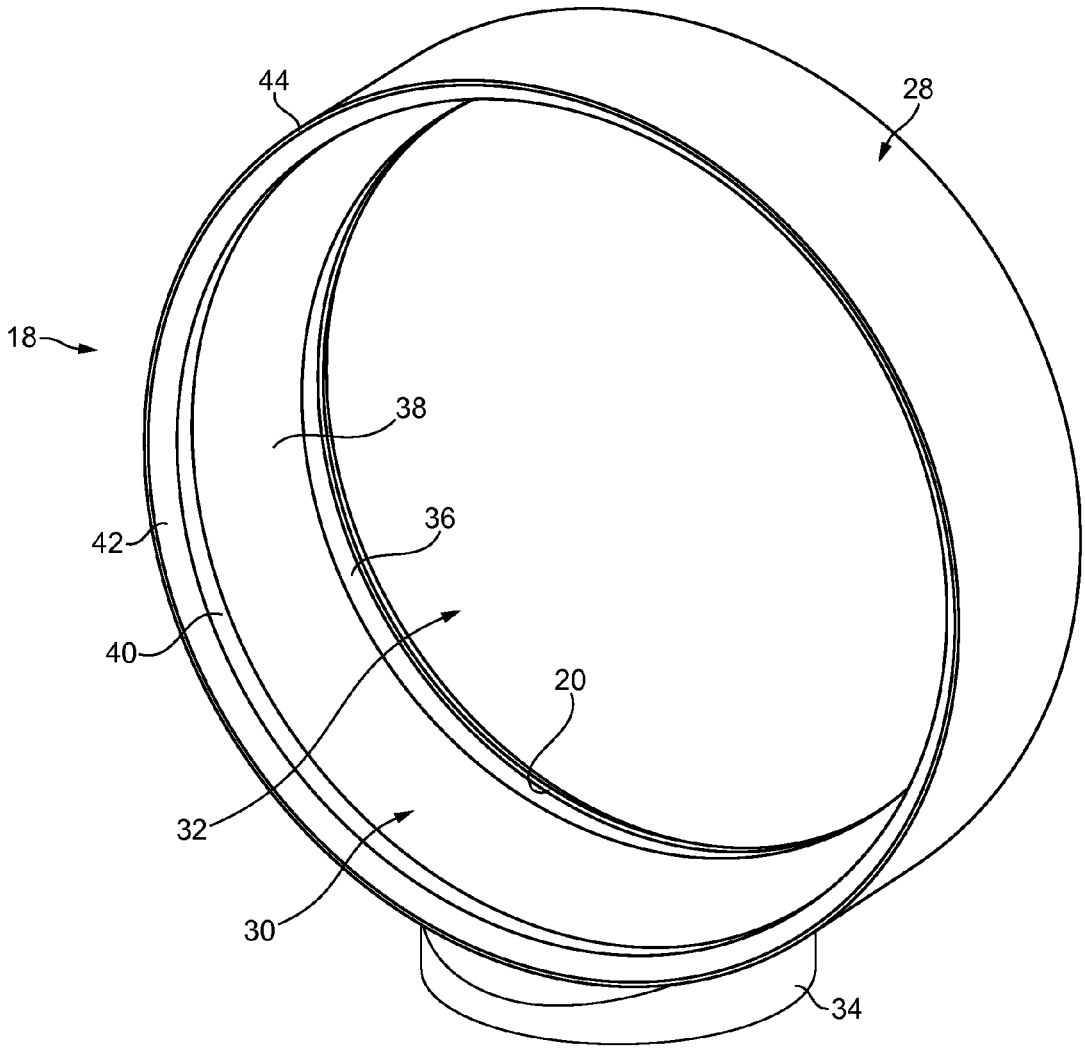
FIG. 2 is a front perspective view, from above, of the air outlet of the fan.
Figure 3:
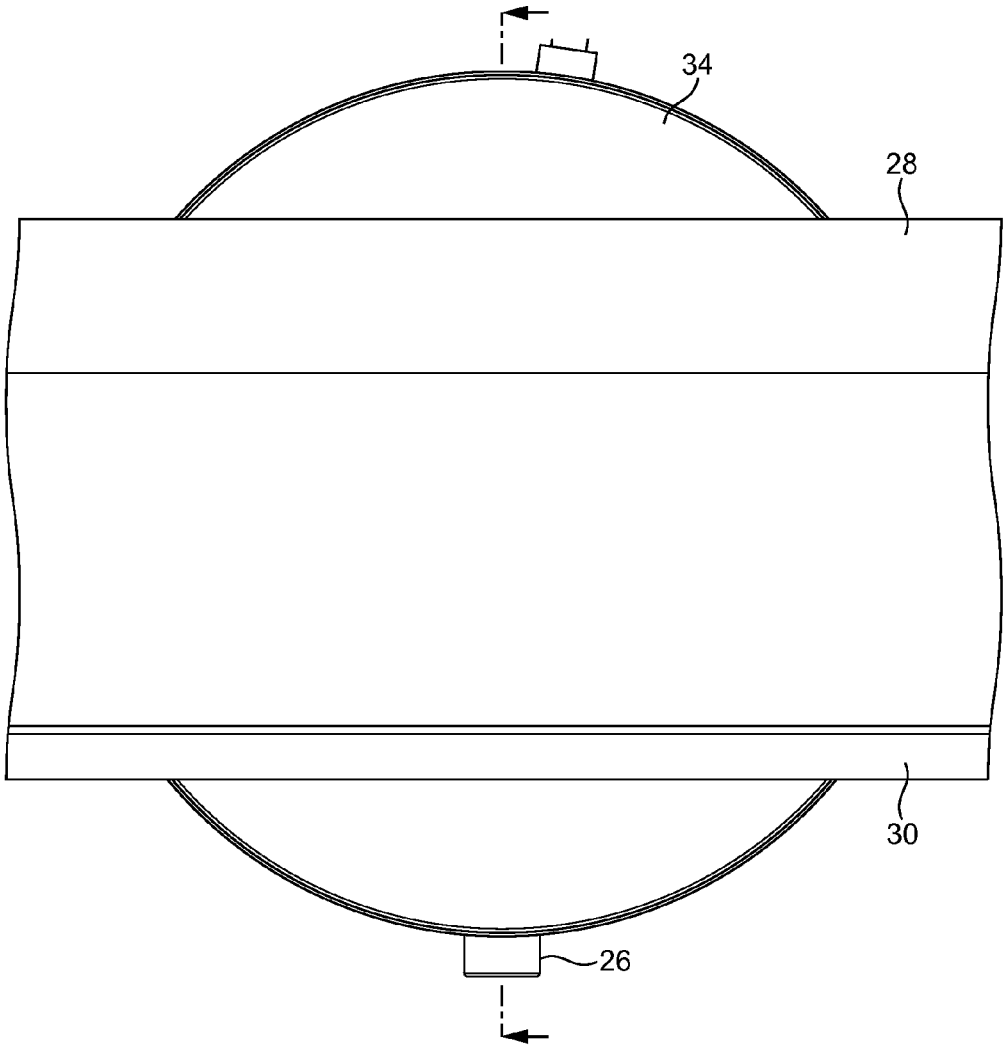
FIG. 3 is a top view of a central part of the fan.
Figure 4:
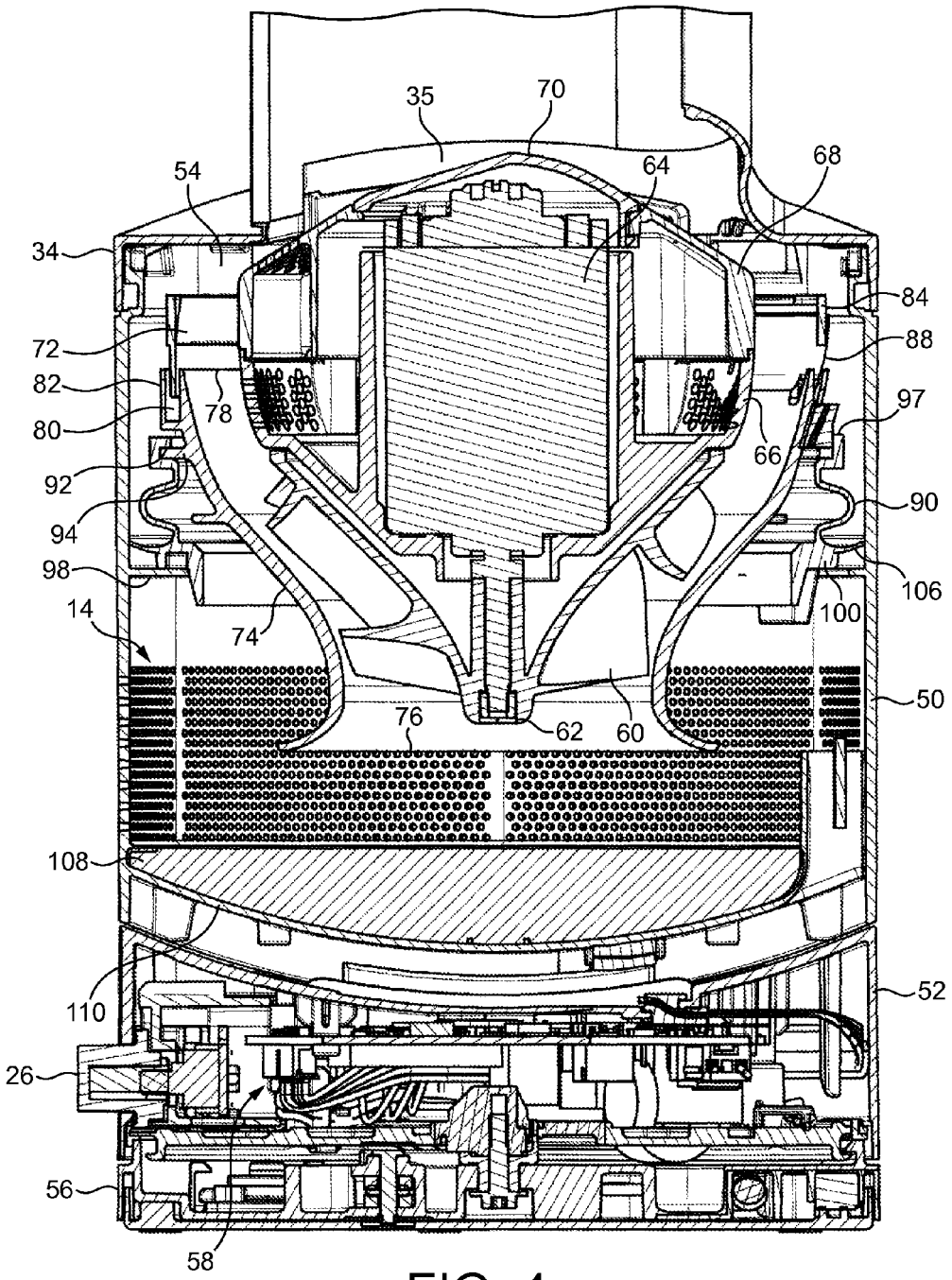
FIG. 4 is a side sectional view of the lower part of the fan, taken along line A-A in FIG. 3.
Figure 5:
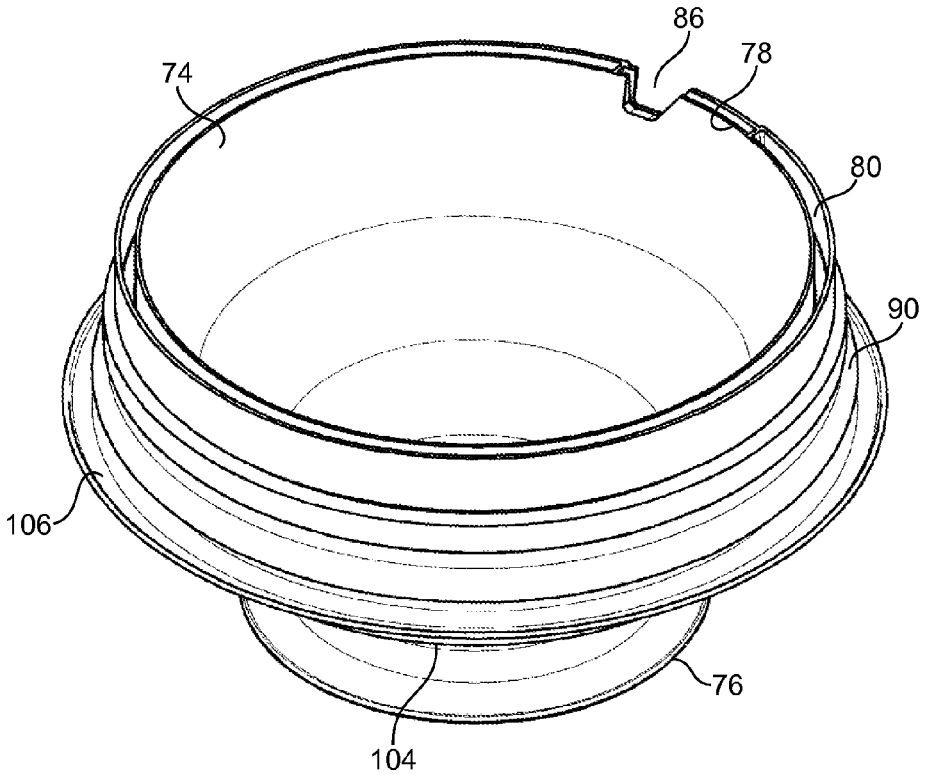
FIG. 5 is a front perspective view, from above, of the impeller casing and the bellows support of the fan.
Figure 6:
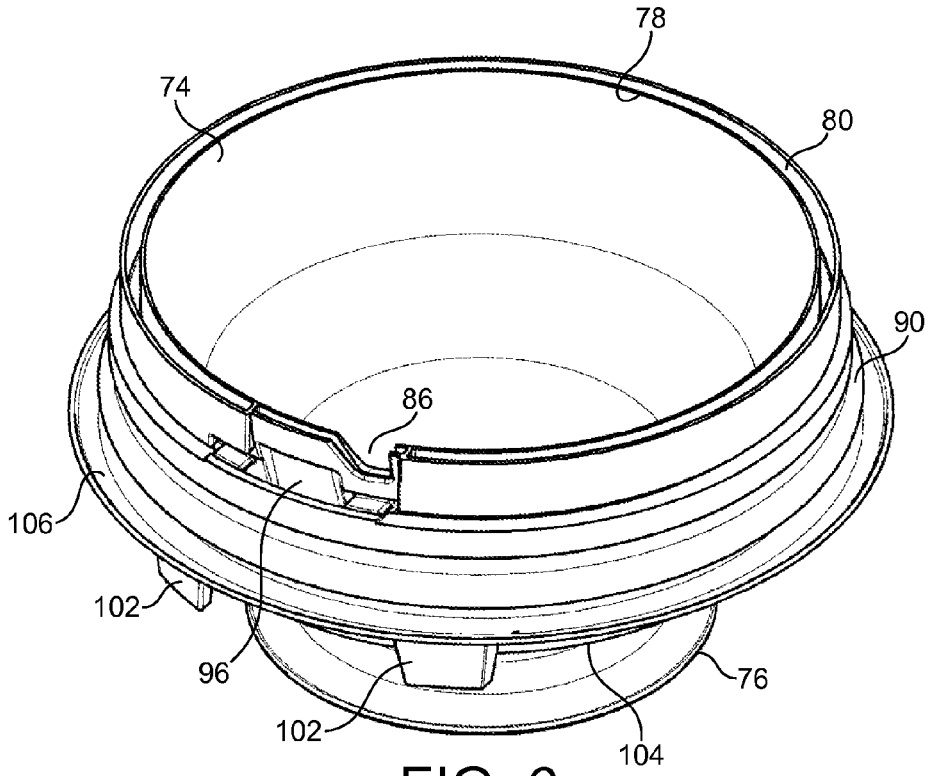
FIG. 6 is a rear perspective view, from above, of the impeller casing and the bellows support ember of the fan.
Figure 7:
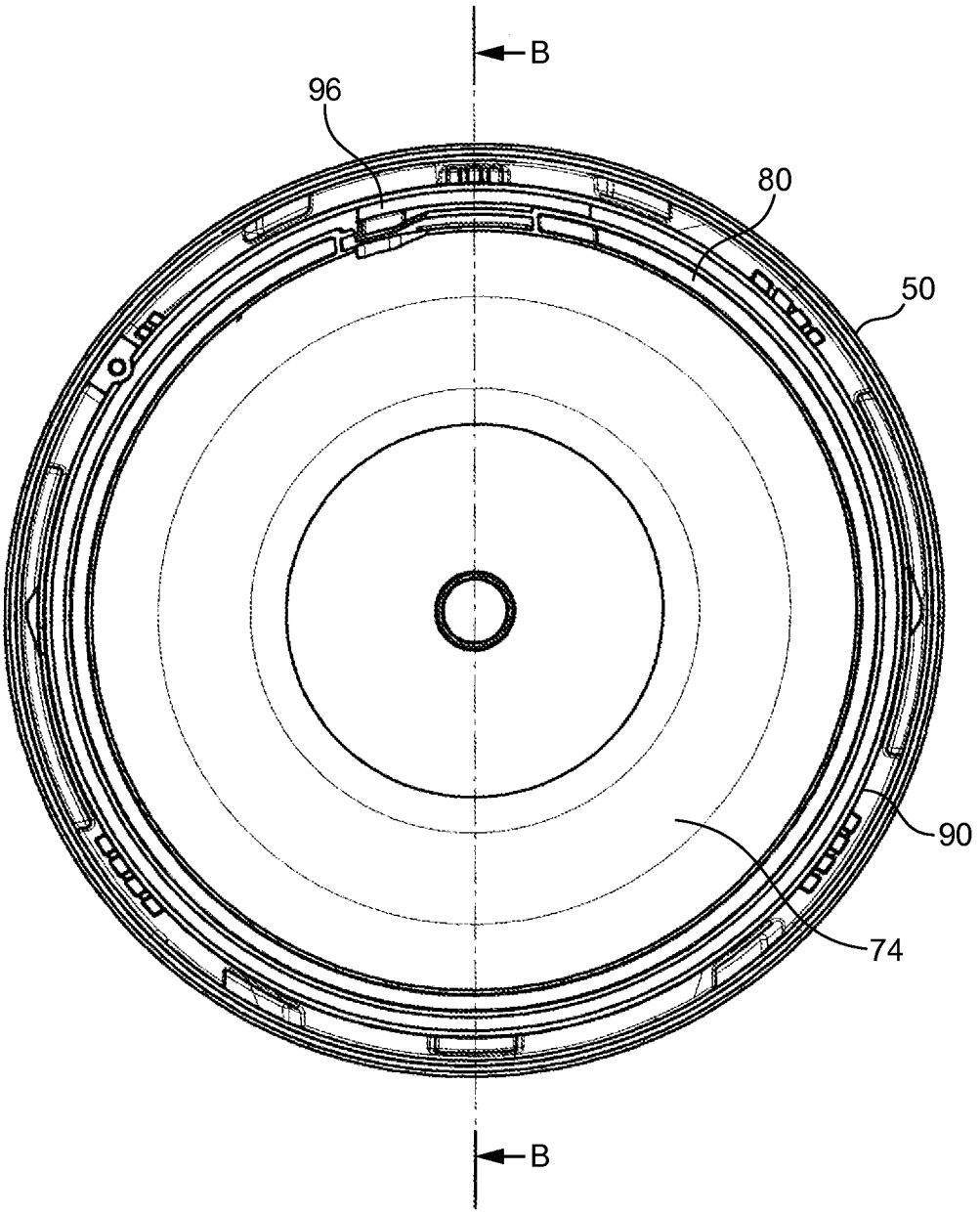
FIG. 7 is a top view of the motor casing section of the base of the fan, housing the impeller casing and bellows support.
Figure 8:
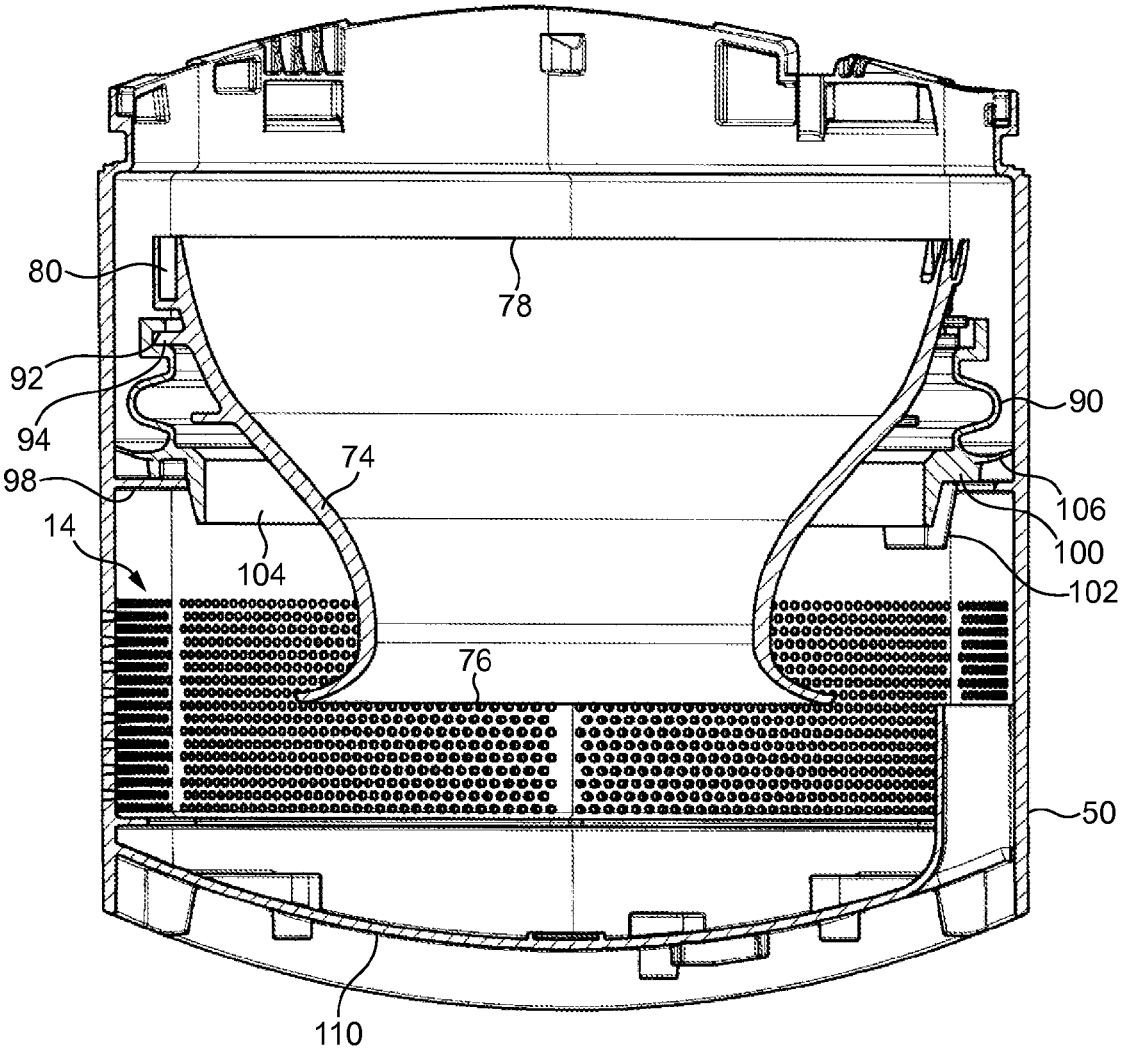
FIG. 8 is a side sectional view of the motor casing section, impeller casing and bellows support, taken along line B-B in FIG. 7.

As also shown in FIG. 2, the casing 14 comprises an annular outer casing section 28 connected to and extending about an annular inner casing section 30. The annular sections 28, 30 of the casing 14 extend about and define an opening 32. Each of these sections may be formed from a plurality of connected parts, but in this embodiment each of the outer casing section 28 and the inner casing section 30 is formed from a respective, single molded part. During assembly, the outer casing section 28 is inserted into a slot located at the front of the inner casing section 30, as illustrated in FIGS. 3 and 4. The outer and inner casing sections 28, 30 may be connected together using an adhesive introduced to the slot. The outer casing section 28 comprises a base 34 which is connected to the open upper end of the casing 16 of the body 12, and which has an open lower end for receiving the primary air flow from the body 12.

The outer casing section 28 and the inner casing section 30 together define an annular interior passage 35 (shown in FIG. 4) for conveying the primary air flow to the air outlet 20. The interior passage 35 is bounded by the internal surface of the outer casing section 28 and the internal surface of the inner casing section 30. The base 34 of the outer casing section 28 is shaped to convey the primary air flow into the interior passage 35 of the casing 14.

The air outlet 20 is located towards the rear of the casing 14, and is arranged to emit the primary air flow towards the front of the fan 10, through the opening 32. The air outlet 20 extends at least partially about the opening 32, and preferably surrounds the opening 32. The air outlet 20 is defined by overlapping, or facing, portions of the internal surface of the outer casing section 28 and the external surface of the inner casing section 30, respectively, and is in the form of an annular slot, preferably having a relatively constant width in the range from 0.5 to 5 mm. In this example the air outlet has a width of around 1 mm. Spacers may be spaced about the air outlet 20 for urging apart the overlapping portions of the outer casing section 28 and the inner casing section 30 to maintain the width of the air outlet 20 at the desired level. These spacers may be integral with either the outer casing section 28 or the inner casing section 30.

The air outlet 20 is shaped to direct the primary air flow over the external surface of the inner casing section 30. The external surface of the inner casing section 30 comprises a Coanda surface 36 located adjacent the air outlet 20 and over which the air outlet 20 directs the air emitted from the fan 10, a diffuser surface 38 located downstream of the Coanda surface 36 and a guide surface 40 located downstream of the diffuser surface 38. The diffuser surface 38 is arranged to taper away from the central axis X of the opening 32 in such a way so as to assist the flow of air emitted from the fan 10. The angle subtended between the diffuser surface 38 and the central axis X of the opening 32 is in the range from 5 to 25°, and in this example is around 15°. The guide surface 40 is arranged at an angle to the diffuser surface 38 to further assist the efficient delivery of a cooling air flow from the fan 10. The guide surface 40 is preferably arranged substantially parallel to the central axis X of the opening 32 to present a substantially flat and substantially smooth face to the air flow emitted from the air outlet 20. A visually appealing tapered surface 42 is located downstream from the guide surface 40, terminating at a tip surface 44 lying substantially perpendicular to the central axis X of the opening 32. The angle subtended between the tapered surface 42 and the central axis X of the opening 32 is preferably around 45°.

FIG. 4 illustrates a side sectional view through the body 12 of the fan 10. The body 12 comprises a substantially cylindrical main body section 50 mounted on a substantially cylindrical lower body section 52. The main body section 50 and the lower body section 52 are preferably formed from plastics material. The main body section 50 and the lower body section 52 preferably have substantially the same external diameter so that the external surface of the upper body section 20 is substantially flush with the external surface of the lower body section 52.

The main body section 50 comprises the air inlet 14 through which the primary air flow enters the fan assembly 10. In this embodiment the air inlet 14 comprises an array of apertures formed in the main body section 50. Alternatively, the air inlet 14 may comprise one or more grilles or meshes mounted within windows formed in the main body section 50. The main body section 50 is open at the upper end (as illustrated) thereof to provide an air outlet 54 through which the primary air flow is exhausted from the body 12.

The main body section 50 may be tilted relative to the lower body section 52 to adjust the direction in which the primary air flow is emitted from the fan assembly 10. For example, the upper surface of the lower body section 52 and the lower surface of the main body section 50 may be provided with interconnecting features which allow the main body section 50 to move relative to the lower body section 52 while preventing the main body section 50 from being lifted from the lower body section 52. For example, the lower body section 52 and the main body section 50 may comprise interlocking L-shaped members.

The lower body section 52 is mounted on a base 56 for engaging a surface on which the fan assembly 10 is located. The lower body 52 comprises the aforementioned user interface and a control circuit, indicated generally at 58, for controlling various functions of the fan 10 in response to operation of the user interface. The lower body section 22 also houses a mechanism for oscillating the lower body section 22 relative to the base 36. The operation of the oscillation mechanism is controlled by the control circuit 58 in response to the user's depression of the button 24 of the user interface. The range of each oscillation cycle of the lower body section 22 relative to the base 36 is preferably between 60° and 120°, and the oscillation mechanism is arranged to perform around 3 to 5 oscillation cycles per minute. A mains power cable (not shown) for supplying electrical power to the fan 10 extends through an aperture formed in the base 56.

The main body section 50 houses an impeller 60 for drawing the primary air flow through the air inlet 14 and into the body 12. The impeller 60 is connected to a rotary shaft 62 extending outwardly from a motor 64. In this embodiment, the motor 64 is a DC brushless motor having a speed which is variable by the control circuit 58 in response to user manipulation of the dial 26. The maximum speed of the motor 64 is preferably in the range from 5,000 to 10,000 rpm.

The motor 64 is housed within a motor housing. The motor housing comprises a lower section 66 which supports the motor 64, and an upper section 68 connected to the lower section 66. The shaft 62 protrudes through an aperture formed in the lower section 66 of the motor housing to allow the impeller to be connected to the shaft 62. The upper section 68 of the motor housing comprises a removable hatch 70 through which the motor 64 is inserted into the motor housing. The upper section 68 comprises an annular diffuser 72 having a plurality of blades for receiving the primary air flow exhausted from the impeller 64 and for guiding the air flow to the air outlet 54 of the main body section 50.

The motor housing is supported within the main body section 50 by an impeller shroud 74. The shroud 74 is generally frusto-conical in shape, and comprises an air inlet 76 at the relatively small, outwardly flared lower end thereof (as illustrated) for receiving the primary air flow, and an air outlet 78 at the relatively large, upper end thereof (as illustrated) which is located immediately upstream from the diffuser 72 when the motor housing is supported within the shroud 74. The impeller 60 and the shroud 74 are shaped so when the impeller 60 and motor housing are supported by the shroud 74, the blade tips of the impeller 60 are in close proximity to, but does not contact, the inner surface of the shroud 74, and the impeller 60 is substantially co-axial with the shroud 74. With reference also to FIGS. 5 to 8, the shroud 74 comprises a groove 80 extending about the air outlet 78 for receiving a downwardly depending projection 82 of the outer wall 84 of the diffuser 72. A first aperture 86 is formed in the upper end of the shroud 74, and a second aperture 88 is formed in the outer wall 84 of the diffuser 72 which aligns with the first aperture 86 when the motor housing is supported by the shroud 74 to enable a cable (not shown) to pass from the control circuit 58 to the motor 64. Both the groove 80 and the projection 82 extend less that 360°, and by substantially the same amount, about the rotational axis of the shaft 62 and the impeller 64 so that the apertures 86, 88 are accurately aligned during assembly. In this example, the groove 80 extends around the rotational axis of the shaft 62 and the impeller 64 by an angle of around 320°. The impeller 64, motor housing and shroud 74 are also preferably formed from plastics material.

The shroud 74 is supported within the main body section 50 by a bellows support 90. The bellows support 90 is preferably formed from elastically deformable material, and in this example is formed from natural rubber. The bellows support 90 extends about the shroud 74. The inner surface of the upper end (as illustrated) of the bellows support 90 comprises a groove 92 for receiving a rib 94 formed on the outer surface of the shroud 74. Again, both the groove 92 and the projection 94 extend less that 360°, and by substantially the same amount, about the rotational axis of the shaft 62 and the impeller 64 to define an aperture 96 between the shroud 74 and the bellows support 90 through which the cable passes between the control circuit 58 and the motor 64. This aperture 96 is sealed by a grommet 97 which is located around the cable so that there is an air-tight seal between the shroud 74 and the bellows support 90. In this example, the groove 92 also extends around the rotational axis of the shaft 62 and the impeller 64 by an angle of around 320°.

Figure 10:
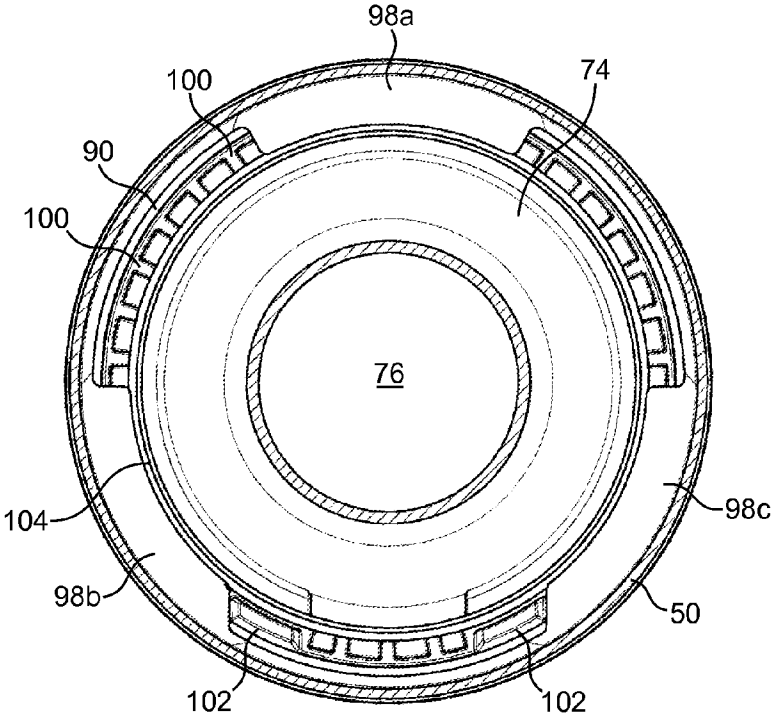
FIG. 10 is a bottom sectional view of the motor casing section, impeller casing and bellows support, taken along line C-C in FIG. 9.
Figure 9:
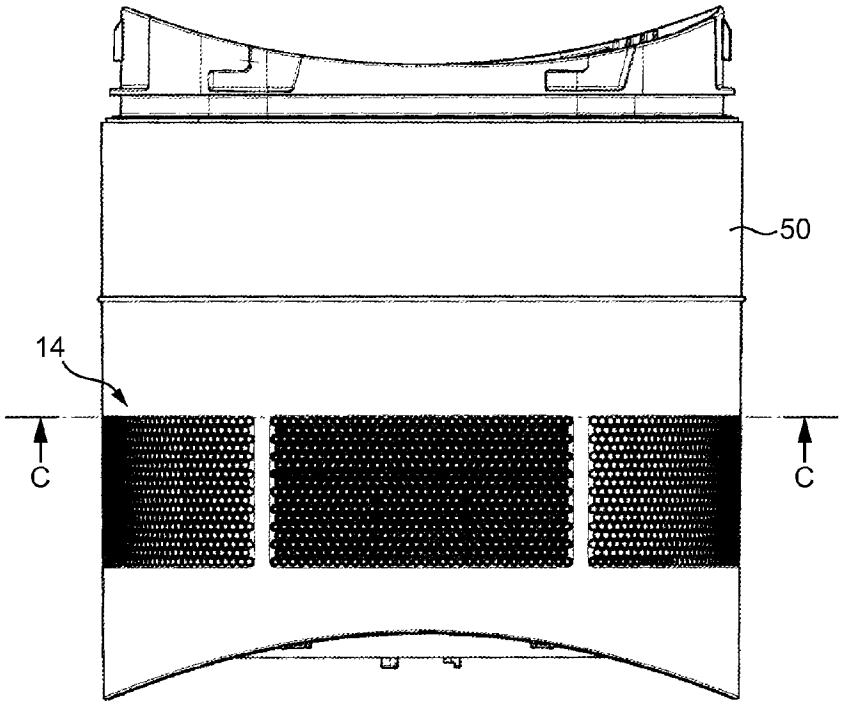
FIG. 9 is a rear view of the motor casing section of the base of the fan, housing the impeller casing and bellows support.

With reference also to FIGS. 9 and 10, the lower end (as illustrated) of the bellows support 90 is annular in shape, and located on a seat 98 connected to the main body section 50. The seat 98 comprises a plurality of support surfaces 98*a*, 98*b*, 98*c* each extending radially inwardly from, and integral with, the inner surface of the main body section 50. The lower end of the bellows support 90 comprises an array of strengthening radial ribs 100, and a pair of lugs 102 which depend from the lower end of the bellows support 90. When the bellows support 90 is mounted on the seat 98, the lugs 102 are located between support surfaces 98*b*, 98*c* of the seat 98, with each lug 102 being located angularly adjacent a respective one of the support surfaces 98*b*, 98*c* to inhibit rotation of the bellows support 90 relative to the main body section 50. As shown in FIG. 10, the support surfaces 98*b*, 98*c* and the lugs 102 are shaped so that the lugs 102 can only be inserted between the support surfaces 98*b*, 98*c*, which ensures correct angular location of the shroud 74 and the bellows support 90 within the main body section 50.

A collar 104 also depends from the lower end of the bellows support 90. The collar 104 has an outer diameter which is substantially the same as the diameter of the radially inner edges of the seat 98 so that when the bellows support 90 is mounted on the seat 98, the collar 104 engages the inner edges of the support surfaces 98*a*, 98*b*, 98*c* of the seat 98. This ensures that the shroud 74 and bellows support 90 are accurately radially aligned within the main body section 50, preferably so that the shroud 74 is co-axial with the main body section 50.

The bellows support 90 also comprises a flexible sealing member extending about the outer surface thereof for engaging the inner surface of the main body section 50. The flexible sealing member is preferably integral with the bellows support 90, and is preferably in the form of an annular lip seal 106. The outer diameter of the lip seal 106 is preferably greater than the diameter of the inner surface of the main body section 50 so that the tip of the lip seal 106 is urged against the inner surface of the main body section 50 when the bellows support 90 is inserted into the casing 16 to form an air tight seal between the motor casing section 50 and the bellows support 90.

Returning to FIG. 4, the body 12 further comprises at least one silencing member for reducing noise emissions from the body 12. In this example, the main body section 50 comprises a disc of acoustic foam 108 between the air inlet 14 and the bottom surface 110 of the main body section 50.

To operate the fan 10 the user presses button 22 of the user interface, in response to which the control circuit 58 activates the motor 64 to rotate the impeller 60. The rotation of the impeller 60 causes a primary air flow to be drawn into the body 12 through the air inlet 14. The user may control the speed of the motor 64, and therefore the rate at which air is drawn into the body 12 through the air inlet 14, by manipulating the dial 26. Depending on the speed of the motor 64, the primary air flow generated by the impeller 60 may be between 20 and 30 liters per second. The rotation of the impeller 60 by the motor 64 generates vibrations which are transferred through the motor housing and the shroud 74 to the bellows support 90. Due to the convoluted shape of the bellows support 90, the upper end of the bellows support 90 is able to move both axially and radially relative to the lower end of the bellows support 90, which inhibits the transfer of these vibrations to the seat 98 lower end of the bellows support 90, and thus to the main body section 50 and the remainder of the body 12 of the fan 10.

The primary air flow passes sequentially between the impeller 60 and the shroud 74, and through the diffuser 72, before passing through the air outlet 54 of the body 12 and into the casing 14. The engagement between the lip seal 106 and the inner surface of the main body section 50 prevents the primary air flow from returning to the air inlet 76 of the shroud 74 along a path extending between the inner surface of the main body section 50 and the outer surface of the shroud 74. The pressure of the primary air flow at the air outlet 54 of the body 12 may be at least 150 Pa, and is preferably in the range from 250 to 1.5 kPa. Within the casing 14, the primary air flow is divided into two air streams which pass in opposite directions around the opening 32 of the casing 14. As the air streams pass through the interior passage 35, air is emitted through the air outlet 20. The primary air flow emitted from the air outlet 20 is directed over the Coanda surface 36 of the casing 14, causing a secondary air flow to be generated by the entrainment of air from the external environment, specifically from the region around the air outlet 20 and from around the rear of the casing 14. This secondary air flow passes through the central opening 32 of the casing 14, where it combines with the primary air flow to produce a total air flow, or air current, projected forward from the casing 14.

The invention claimed is:

1. A fan comprising:

a casing having an air inlet and an air outlet;

an impeller housing located within the casing;

an impeller located within the impeller housing for generating an air flow along a path extending from the air inlet to the air outlet through the impeller housing;

a motor housing connected to the impeller housing;

a motor located within the motor housing for driving the impeller; and a bellows extending about the impeller housing and forming a seal between the impeller housing and the casing, wherein the bellows comprises an annular sealing member extending thereabout for engaging an inner surface of the casing and the annular sealing member comprises a lip seal with an outer diameter greater than an inner diameter of the inner surface of the casing.

2. The fan of claim 1, wherein the sealing member is integral with the bellows.

3. The fan of claim 1, wherein the bellows comprises an upper end connected to the impeller housing and a lower end disposed on a seat connected to the casing.

4. The fan of claim 3, wherein the upper end of the bellows comprises a groove for retaining a generally annular rib located on the outer surface of the impeller housing.

5. The fan of claim 1, wherein the bellows is substantially co-axial with the impeller.

6. The fan of claim 1, comprising a system for inhibiting radial displacement of the bellows support relative to the casing.

7. The fan of claim 6, wherein the system comprises a collar connected to the bellows.

8. The fan of claim 7, wherein the collar extends downwardly from the lower end of the bellows.

9. The fan of claim 7, wherein the bellows comprises an upper end connected to the impeller housing and a lower end disposed on a seat connected to the casing, and wherein the seat surrounds the collar.

10. The fan of claim 3, wherein the seat extends radially inwardly from the inner surface of the casing.

11. The fan of claim 3, wherein the seat is integral with the casing.

12. The fan of claim 1, wherein the impeller housing comprises a shroud extending about and substantially concentric with the impeller.

13. The fan of claim 12, wherein the shroud has an outwardly flared lower end comprising an air inlet for receiving the air flow from the air inlet of the casing.

* * * * *